US009578429B2

(12) United States Patent
Karamuk

(10) Patent No.: US 9,578,429 B2
(45) Date of Patent: Feb. 21, 2017

(54) SUPPORT MOUNT FOR ELECTRONIC COMPONENTS

(75) Inventor: Erdal Karamuk, Meilen (CH)

(73) Assignee: SONOVA AG, Staefa (CH)

( * ) Notice: Subject to any disclaimer, the term of this patent is extended or adjusted under 35 U.S.C. 154(b) by 1058 days.

(21) Appl. No.: 11/558,096

(22) Filed: Nov. 9, 2006

(65) Prior Publication Data

US 2008/0112584 A1 May 15, 2008

(51) Int. Cl.
*H04R 25/00* (2006.01)

(52) U.S. Cl.
CPC ..... *H04R 25/604* (2013.01); *H04R 25/456* (2013.01); *H04R 25/60* (2013.01)

(58) Field of Classification Search
USPC ..... 381/324, 328, 354, 368; 181/130, 135
See application file for complete search history.

(56) References Cited

U.S. PATENT DOCUMENTS

| | | | | |
|---|---|---|---|---|
| RE26,258 | E * | 8/1967 | Martin | 381/328 |
| 3,529,102 | A * | 9/1970 | Rosenstand | 381/324 |
| 4,729,451 | A | 3/1988 | Brander | |
| 4,854,415 | A * | 8/1989 | Goschke | 181/130 |
| 6,549,634 | B1 * | 4/2003 | Vonlanthen | 381/322 |
| 6,813,364 | B1 * | 11/2004 | Vonlanthen | 381/322 |
| 7,058,192 | B2 * | 6/2006 | Muller et al. | 381/326 |
| 7,074,296 | B2 * | 7/2006 | Vonlanthen | 156/293 |
| 7,076,074 | B2 * | 7/2006 | Gebert et al. | 381/322 |
| 7,130,437 | B2 * | 10/2006 | Stonikas et al. | 381/322 |
| 7,174,028 | B1 * | 2/2007 | Niccolai | 381/322 |
| 7,227,968 | B2 * | 6/2007 | van Halteren et al. | 381/328 |
| 7,263,194 | B2 * | 8/2007 | Niederdrank et al. | 381/324 |
| 7,362,878 | B2 * | 4/2008 | Miller et al. | 381/418 |
| 7,376,237 | B2 * | 5/2008 | Westerkull | 381/326 |
| 2002/0106096 | A1 * | 8/2002 | Vonlanthen | 381/330 |
| 2002/0196958 | A1 * | 12/2002 | Halteren et al. | 381/328 |
| 2006/0034474 | A1 * | 2/2006 | Topholm et al. | 381/322 |
| 2006/0045298 | A1 * | 3/2006 | Westerkull | 381/326 |
| 2007/0116312 | A1 * | 5/2007 | Niccolai | 381/322 |
| 2009/0016553 | A1 * | 1/2009 | Ho et al. | 381/324 |

FOREIGN PATENT DOCUMENTS

| | | | |
|---|---|---|---|
| EP | 0 993 759 | B1 | 10/2001 |
| EP | 1 248 496 | A2 | 10/2002 |
| EP | 1248496 | A2 | 10/2002 |
| EP | 1 316 239 | B1 | 6/2003 |
| EP | 0 127 441 | A2 | 12/2005 |
| WO | 00/79835 | A1 | 12/2000 |
| WO | 2005/055652 | A1 | 6/2005 |

* cited by examiner

*Primary Examiner* — Bradley Duckworth
(74) *Attorney, Agent, or Firm* — Pearne & Gordon LLP

(57) ABSTRACT

For the cushioned support of electronic components in a mounting enclosure of a miniaturized electronic device, an elastic and/or flexible retaining element (15) with inward-protruding support sections (17) extends along at least parts of the inner wall of the mounting enclosure (3), serving to position, support and retain the component (1).

2 Claims, 4 Drawing Sheets

SUPPORT MOUNT FOR ELECTRONIC COMPONENTS

BACKGROUND OF THE INVENTION

Field of the Invention

This invention relates to a system for the cushioned support of electronic components as conceptually specified in claim 1, and to a method for producing such integrated, cushioned support mounts by means of said system.

The object of this invention is a structure for supporting electro-acoustic transducers and other electronic components in miniaturized devices such as hearing aids. Electronic components such as hearing-aid receivers or electro-acoustic transducers are most commonly held in place by means of rubber mounts. In most cases these rubber mounts are plugged, glued or slipped directly onto the electronic component, defining the area of contact with the remainder of the electronic miniature device such as the architecture of a hearing aid. In addition to the individual supports it is usually necessary to also accommodate leads and for instance a sound conductor that connects the component to the acoustic surroundings and often serves as a mechanical support as well.

These traditional rubber mounts serve three functions:

- they hold the electronic component in its intended position within the miniature device, for instance a transducer in a hearing aid;
- they isolate the component from its mechanical surroundings, absorbing vibrations; and
- they protect the electronic component against percussive impact.

Description of Related Art

Existing literature describes various approaches to obtaining a cushioned support for electronic components as outlined above, for instance for the mounting of transducers and in particular receivers (speakers) in hearing aids. For example, EP 1 248 496 describes a multi-part receiver support that is adapted to the force distribution pattern on the receiver surface by means of rubber segments featuring different degrees of rigidity. U.S. Pat. No. 4,729,451 describes an integrated mount for the receiver of an in-ear hearing aid. A receiver mock-up is placed in a single shell and the tip of the shell is filled with a liquefied rubber material. After the curing the mock-up is removed, leaving behind an integral cavity that then serves as the receiver mount.

U.S. Pat. No. 6,751,326 describes a support concept whereby a receiver is mounted in a two-part enclosure. The rubber parts are mounted on the receiver and/or on the enclosure.

WO 2005/055652 describes a receiver mount in a hearing aid which mount is held in place by means of multiple rubber parts that must be attached to the receiver as well as to certain segments of the enclosure.

EP 1 316 239 includes a general description and a few application examples for employing multi-component injection molding techniques in producing hearing aids. These involve enclosure seals, sound channels for sound entry and exit, and an elastic mounting cavity for transducers.

Finally, WO 00/79835 addresses a behind-the-ear hearing aid that incorporates an electroacoustic transducer with a speaker enclosure that is resiliently mounted in a capsule in such fashion that a space is defined between the capsule and the speaker enclosure.

The drawbacks of these prior-art support mounts include, in particular, the following:

- The rubber parts concerned are relatively expensive to produce and, in view of the small amount of vulcanized material, consistent material properties (rigidity, damping performance) are not always assured.
- Attaching the partly very thin-walled rubber mounts on the transducers is extremely complicated. For one thing, it is very time-consuming in the production process and, for another, the acoustic reliability of the hearing aid depends in large measure on precise assembly. A slight deviation or shift of the rubber parts can skew the transducer in the hearing aid enclosure, leading to acoustic feedback.
- Most prior-art support mounts do not permit any separation between shock absorption and vibration isolation since both functions must be performed by the same component, consisting of the same material.

Of course, there are approaches that are less demanding on the mounting of transducers. In one, the transducer is made more insensitive to percussive shocks, as described for instance in EP 0 993 759. Moreover, transducer manufacturers have made efforts aimed at lowering receiver vibration, as described for instance in EP 1 248 496, in U.S. Pat. No. 6,751,326 or in EP 127 442. These approaches are all going in the right direction but may in certain cases prove to be unsuitable for a particular use in hearing aids because they increase the cost and/or size of the transducer.

BRIEF SUMMARY OF THE INVENTION

Given the above considerations, it is an objective of this invention to introduce a support mount for electronic components such as a transducer in a miniaturized electronic device, for instance a hearing aid, capable of meeting the key requirements described below, these being the vibration isolation of the component and the shock absorption in the event of a percussive impact.

The device proposed according to the invention offers the features specified in claim 1.

The system according to the invention, designed for the cushioned support of electronic components in a single- or multi-part mounting enclosure of a miniaturized electronic device, is based on a concept whereby, along at least segments of the inner wall of the mounting enclosure, an elastic and/or flexible retaining element is provided, with support sections protruding toward the inside of the enclosure and serving to position and retain the component in the enclosure.

As mentioned above, the cushioned mounting system according to the invention serves two basic functions, one being vibration isolation, the other being shock absorption. It has been found that for vibration isolation, the rigidity of the support should be low to very low with a low attenuation level. By contrast, unlike the vibration isolation, shock absorption requires a far more rigid mount, desirably with a substantially greater internal damping capability of the material.

In a proposed design variation of the invention, the mounting enclosure is at least partly lined with a soft elastic and/or flexible material with prominences protruding from the lining layer. These protuberances may be in the form of ridges, cones or nubs, with pointed, blunt or rounded tips for supporting the electronic component.

In another design variation, the liner and the retaining element may consist of the same material as the support protuberances, i.e. the prominences projecting from the lining layer, or different materials may be selected for the support sections and protuberances to meet the different above-mentioned requirements for vibration isolation and shock absorption.

The retaining element, the liner and the protuberances or support segments may consist of a thermoplastic elastomer (TPE). Block copolymers such as styrene elastomers (TPE-S) or polymer blends such as a polyolefin elastomer (TPE-0) have been found to be particularly well-suited. However, depending on the application, other TPE types may be equally suitable, for instance thermoplastic polyurethane (TPE-U) or vulcanized materials such as silicone rubber etc.

Particularly suitable materials include those with a Shore hardness of >25, preferably in the range from 30 to 60.

Other preferred design variations of the inventive system for the cushioned support of an electronic component are defined in the dependent sub-claims.

There are various ways in which the inventive system and the installation of the cushioning retaining element in a mounting enclosure for an electronic component can be implemented.

As a first step the retaining element with the support sections may be produced for instance by injection molding and then installed in a mounting enclosure. Alternatively, the retaining element and the elastic liner may be produced, again for instance by injection molding, and introduced directly into an existing mounting enclosure which on its part may consist of a duroplastic or thermoplastic polymer.

In another form of implementation it is possible to produce the mounting enclosure and the cushioning system directly by the so-called two-component injection molding method, whereby in simultaneous or consecutive injection processes the polymer concerned is injected into the mold.

BRIEF DESCRIPTION OF THE SEVERAL VIEWS OF THE DRAWINGS

The following will explain the invention in more detail with the aid of examples and with reference to the attached drawings in which.

DETAILED DESCRIPTION OF THE INVENTION

Figure 1:
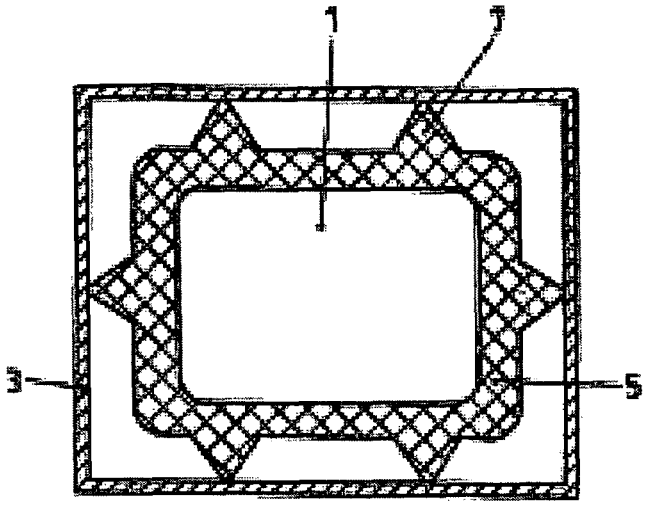
FIG. 1 is a schematic section view of a prior-art support mount for an electronic component.
Figure 2:
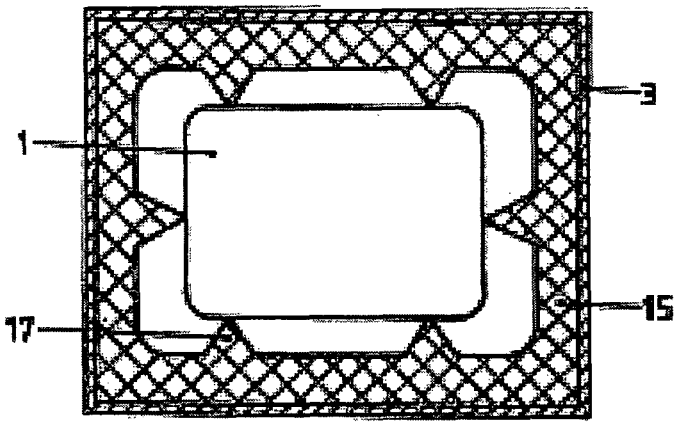
FIG. 2 is a schematic section view of a support mount for an electronic component according to this present invention.

The basic concept of this invention consists in the fact that the support mount is integrated into the enclosure of the electronic device such as a hearing aid, illustrated in FIGS. 1 and 2 depicting an example of a receiver support, and described below. Its main difference from prior art, shown in FIG. 1, is that the support mount is no longer attached to the transducer but constitutes part of the hearing aid enclosure as illustrated in FIG. 2.

FIG. 1 is a schematic section view of a transducer 1 positioned in a corresponding hearing aid enclosure 3. For shock absorption and vibration isolation it is provided with a rubber mount 5 exhibiting outward-protruding support fins 7 for point support.

By contrast, as shown in FIG. 2, the transducer 1 is no longer embedded in a rubber mount 5 but rests "freely" on support fins 17 that are part of a cushioning insert which is directly attached to the inner surface of the hearing aid enclosure 3. The insert encompasses a rubber pad 15 with inward-protruding support fins 17 for point support.

As indicated in FIG. 2, the hearing aid cavity that accommodates the transducer is lined with a layer of a soft, elastic material of sufficient wall thickness and rigidity to meet the above-mentioned shock-absorbing requirements. Protruding from that layer are various cone- or fin-shaped prominences 17 that serve to hold the transducer 1 in a defined position. These support elements 17 can be so shaped and configured as to provide the necessary rigidity for optimized vibration isolation. For example, these elements can be configured to respond primarily to transverse thrust rather than to pressure loads, allowing for far less rigidity.

Figure 3:
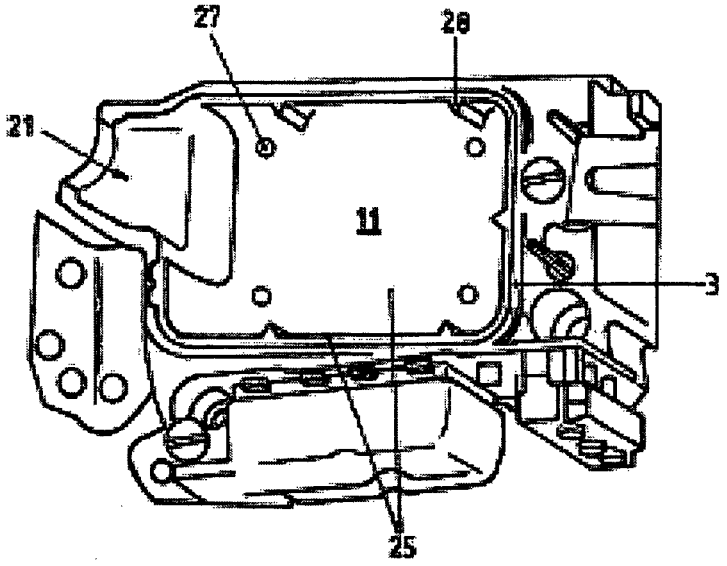
FIG. 3 is a perspective section view of one possible design variation of a cushioning support mount configured to accept an electronic component.

The following will describe a specific application example of the invention with reference to FIG. 3, involving a receiver mount that is installed, for instance by a two-component injection molding process, directly into the hearing aid enclosure. The enclosure 3 is of a multi-part design, with each part featuring a segment of the integral support mount. This integrated mount is characterized by the following:

- The primary support 25 is injection-molded using a thermoplastic elastomer (TPE).
- The support mount is incorporated directly into the enclosure 3 in one single operation by a two-component injection-molding technique.
- The support mount 25 is attached to the enclosure 3 by adhesion employing hard/soft bonding techniques.
- The wall of the support mount 25 is thick enough to absorb a percussive impact.
- The material is of medium hardness with low rebound resilience, with a Shore hardness preferably in the range from 30 to 60. Typical examples include a thermoplastic SEBS-based elastomer (styrene-ethylene-butylene-styrene).
- The transducer rests on several thin points 27 of very low rigidity.
- The support mount includes lateral support fins 28 that serve to lock the transducer in place.

The multi-part hearing aid enclosure thus produced can now accept the transducer in the cavity created for that purpose. The enclosure is additionally provided with an opening 21 for the sound channel, sound tube, connectors etc. Apart from the features described above it is, of course, possible to add the following:

- The support mount is integrated in the enclosure in a second procedural step for which the enclosure must be placed in an injection mold.
- For the connection between the mount and the enclosure the mere adhesive attachment is reinforced by mechanical anchoring. This can be accomplished either by mechanical structural elements (drill holes, interlocks etc.) or by enlarging the specific surface of the enclosure through chemical or physical etching, given the fact that especially in the case of hearing aids there is often not enough space for mechanical anchoring.
- The support mount consists of a hot-vulcanized silicone material that can also be injection-molded.

The mount additionally includes an enclosure gasket and/or a seal for the sound exit port 21.

Figure 4:
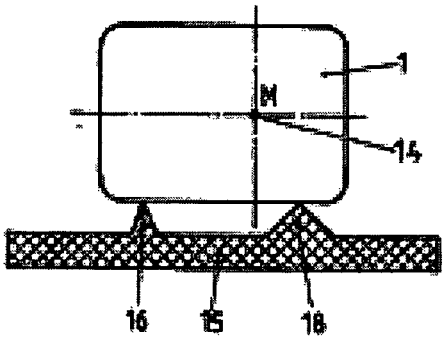
FIG. 4 is a schematic illustration of the cushioned support of an electronic component having an asymmetric center of mass.

The support fins 28 and support points 27 can be so configured and positioned as to create a static balance for the mount. This may even include compensation for the fact that the activation of the receiver is not symmetrical, as schematically illustrated in FIG. 4. Due to the internal structure of the transducer its center of mass M or 14 is outside its geometric center. A static balance of the mount is still attainable by forming the support points in such fashion that for instance the support point 18, located closer to the mass center, is more rigid than the other point, 16. In theory, of course, this can also be achieved with prior-art support mounts, except that the space limitations would become even more stringent, since any symmetry of the mounts would be lost.

Figure 5:
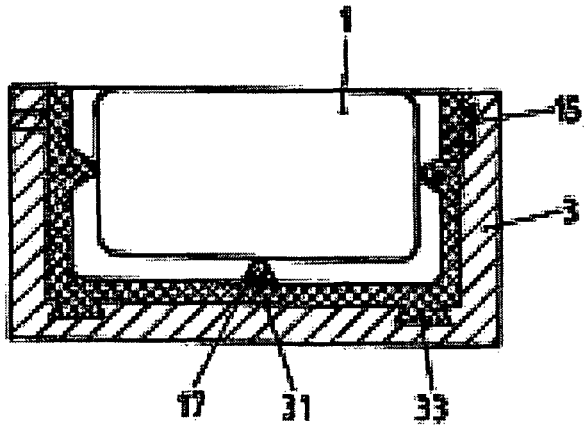
FIG. 5 is another design variation of a cushioned support mount.
Figure 6:
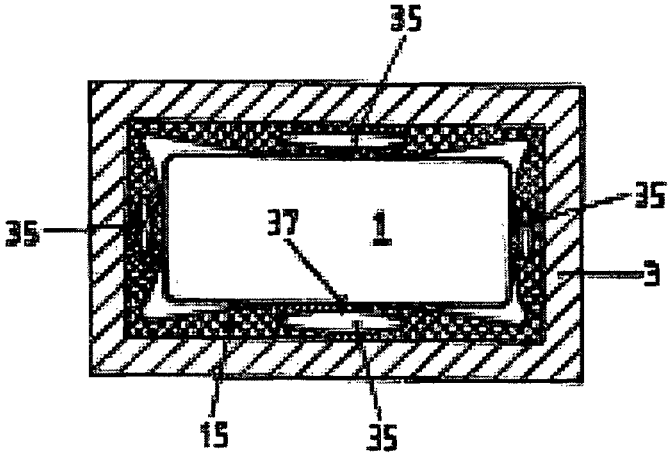
FIG. 6 is a section view of another implementation variant of the cushioning system according to the invention.

FIG. 5 is a section view of another design variation of a cushioning system according to the invention for the mounting of an electronic component 1. Here as well, the rigid enclosure wall 3 of a miniaturized electronic device is lined with an inner damping layer 15 consisting of an elastic material as described above. As in the preceding examples, inward-projecting protuberances 17 serve to support the component 1. In addition, as shown in FIG. 5, the inward projections 17 also have air gaps 31 for an added cushioning effect. These damping air gaps 31 may be kept relatively small as in FIG. 5 or, as illustrated in FIG. 6 with the reference number 35, they may be so shaped as to give the inward-projecting protuberance 37 the form of a cushion or leaf spring. While this enhances the damping effect, it reduces the positional stability of the mount.

Also visible in FIG. 5 are dovetail interlocks 33 for a better or even non-adhesive connection between the damping layer 15 and the rigid enclosure wall 3.

Figure 7A:
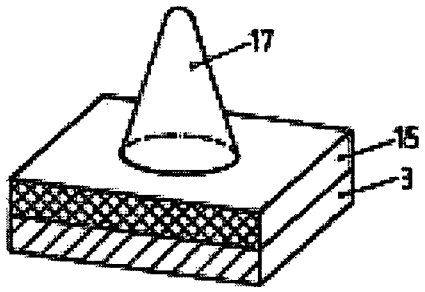
FIG. 7*a*-7*d* are examples of damping elements that are suitable for a cushioning system.
Figure 7B:
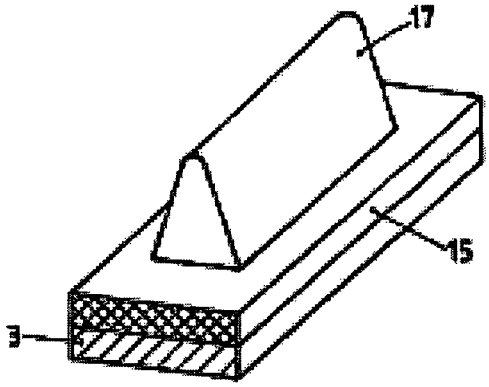
Figure 7C:
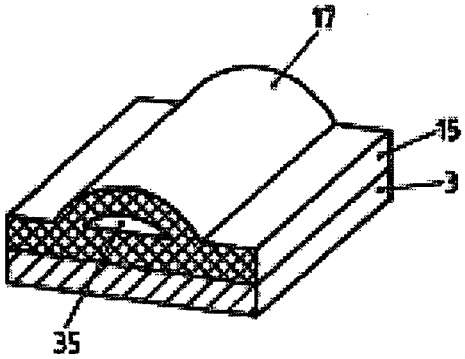
Figure 7D:
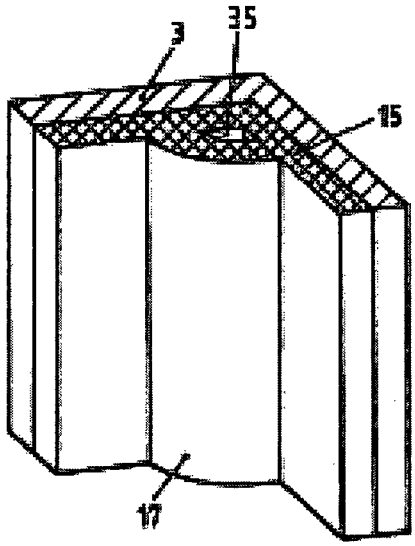

FIGS. 7*a* to 7*d* illustrate examples of inward-protruding prominences 17 to demonstrate that for achieving a particular damping effect, i.e. depending on whatever the requirements are, any suitable shape can be selected. FIG. 7*a*, for instance, shows a cone-shaped protuberance, FIG. 7*b* a fin, FIG. 7*c* a cushion- or leaf-spring shaped damping element 17 as in FIG. 6. Similarly, the leaf-spring-shaped damping element 17 in FIG. 7*d* is provided in the corner of the mounting enclosure 3. Here again, a hollow space 35 serves to enhance the damping effect.

The advantages of this invention lie in the fact that the cost of producing the cushioned support mount can be reduced:

The cost of rubber parts is eliminated.

Integrating the support mounts substantially reduces the assembly effort since instead of having to individually slip the soft rubber parts over the transducers, the transducer is simply inserted in the cavity provided for that purpose.

Simplified assembly also helps production tolerances since it is more difficult to install the transducers the wrong way.

Integrating the support mounts permits the use of new designs which, by virtue of the substantial separation of the two functions, i.e. vibration isolation and shock absorption, can result in greater dependability as well as enhanced performance.

Support-mount integration permits the use of a mount design that is especially optimized for a particular type of transducer. Statically balanced mounts are more easily obtained without the need to create complex assembly instructions or to install additional rubber parts.

Of course, the damping systems and support mounts illustrated in FIGS. 1 to 7 represent examples only, provided for a better understanding of the invention. It follows that the mounts and cushioning systems are not limited to the examples shown; instead, deviating support-mount and damping-system designs may be used, for instance with a different wall thickness, different degrees of material rigidity, different geometries or configurations of the protruding support sections or protuberances, different manufacturing techniques, and so forth. The key aspect of this invention is that the damping element, i.e. the cushioning support mount is attached to the inner enclosure wall of the electronic device for positioning and retaining an electronic component and that the damping element is provided with inward-pointing, inward-protruding support sections.

The invention claimed is:

1. Method for producing a system for cushioned support of an electronic component (1) in a multi-part mounting enclosure (3) of a miniaturized electronic device, the system comprising an elastic and/or flexible retaining element (15) that extends along a portion of an inner wall of a plurality of separate enclosure portions that collectively form an exterior periphery of the mounting enclosure (3) and are provided with inward-protruding support sections (17) serving to position and retain the electronic component (1) within the mounting enclosure (3), the method comprising forming a at least one of the enclosure portions of the mounting enclosure (3) for the electronic component (1) together with the retaining element (15) comprising the support sections (17) in a single molding operation by utilizing a two-component injection-molding technique to bond the retaining element to the at least one of the enclosure portions of the mounting enclosure (3), during which the retaining element (15) and the support sections (17) are molded from a thermoplastic elastomer.

2. Method for producing a system as in claim 1, characterized in that a bond between the support sections (17) and the mounting enclosure (3) for the electronic component (1) couples at least two different materials together, each of said different materials comprising a different hardness.

* * * * *